United States Patent [19]

Dickensheets et al.

[11] 3,956,434

[45] May 11, 1976

[54] CARBURETOR COLD ENRICHMENT FUEL METERING SIGNAL AND AIR FLOW MODULATOR

[75] Inventors: William E. Dickensheets, Southfield; Robert S. Harrison, Grosse Ile; Max W. Lunsford, Southfield; John D. Medrick, Plymouth; Alvin P. Nowroski, Livonia; Charles K. Weslock, Harper Woods, all of Mich.

[73] Assignee: Ford Motor Company, Dearborn, Mich.

[22] Filed: Aug. 21, 1975

[21] Appl. No.: 606,829

Related U.S. Application Data

[63] Continuation of Ser. No. 430,956, Jan. 4, 1974, abandoned.

[52] U.S. Cl. ..... 261/39 B; 261/44 R; 261/50 A; 261/64 R

[51] Int. Cl.[2] ..... F02M 1/10

[58] Field of Search..... 261/39 A–39 D, 44 R, 261/50 A, 52, 64 R, DIG. 67

[56] References Cited

UNITED STATES PATENTS

| | | | |
|---|---|---|---|
| 3,069,146 | 12/1962 | MacNeill | 261/44 R |
| 3,243,167 | 3/1966 | Winkler | 261/50 A X |
| 3,272,488 | 9/1966 | Bickhaus | 261/50 A X |
| 3,307,837 | 3/1967 | Winkler | 261/DIG. 67 X |
| 3,333,832 | 8/1967 | O'Neill | 261/50 A X |
| 3,342,464 | 9/1967 | Mick | 261/44 R |
| 3,642,256 | 2/1972 | Phelps | 261/39 D |
| 3,831,909 | 8/1974 | Freismuth | 261/39 A |
| 3,831,910 | 8/1974 | Shadbolt | 261/DIG. 67 X |

*Primary Examiner*—Tim R. Miles
*Assistant Examiner*—William Cuchlinski, Jr.
*Attorney, Agent, or Firm*—Robert E. McCollum; Keith L. Zerschling

[57] ABSTRACT

A variable area venturi carburetor has a wall movable by a servo controlled by venturi-like control vacuum to vary the area and thereby change airflow capacity and fuel flow; a tapered fuel metering rod is attached to the wall and cooperates with a stationary fuel jet; during cold engine operation, a temperature responsive device progressively blocks the flow of the control vacuum as the temperature decreases, to permit higher ported manifold vacuum also acting on the servo to open the venturi wider to change the fuel metering signal while withdrawing the fuel metering rod, to provide a change in richness. Return to normal temperature causes the control vacuum to bleed the ported manifold vacuum to the control vacuum level.

4 Claims, 10 Drawing Figures

CARBURETOR COLD ENRICHMENT FUEL METERING SIGNAL AND AIR FLOW MODULATOR

This is a continuation of application Ser. No. 430,956, filed Jan. 4, 1974, now abandoned.

This invention relates, in general, to an internal combustion engine carburetor. More particularly, it relates to a device for use during cold weather engine cranking and running operations to supply a mixture of air and fuel to the carburetor that is richer than the normal running air/fuel mixture.

The advent of lower vehicle hoodlines necessitates a change in engine carburetion design. The prior art carburetor designs of the downdraft type generally include in the induction passage a choke valve located above the fuel metering venturi. This adds height to the carburetor and necessitates either providing a hump in the hood or higher hood profiles.

This invention relates to a carburetor design that eliminates the need for a choke valve and thereby permits decreasing the overall height of the carburetor. The invention compensates for the lack of a choke system by providing a cold enrichment device that adds extra fuel to the carburetor during cold weather operation. The conventional choke valve effects an overrich mixture during engine cranking operations, followed by a cracking open of the choke valve a small amount to lean the mixture to a less rich but still richer than normal level. The conventional choke valve, therefore, controls the flow of both air and fuel and causes additional fuel and air to be added to the system during cold weather operation.

The present invention accomplishes the same objectives as a conventional choke valve without requiring the use of one. More particularly, the present invention relates to a variable area venturi type carburetor with a movable wall and consists of a temperature responsive device to modulate the supply of fuel to the engine during cold engine operations, to follow a specific schedule providing the desired engine operation. The device is located in a vacuum line used to control movement of the wall, and changes the position of the movable wall from the position it would normally attain under the influence of the venturi-like control vacuum alone to one that will provide a different air/fuel mixture schedule providing a desired engine operation. This modulating of the control vacuum continues until the normal engine operating temperature is reached, at which time the device is rendered ineffective.

It is one of the objects of the invention, therefore, to provide a cold enrichment device for an internal combustion engine carburetor to control the richening of the normal carburetor air/fuel mixture during cold weather engine running operations according to a predetermined schedule.

It is a further object of the invention to provide a cold enrichment device of the type described in which a vacuum level control valve movable by temperature controls automatically regulates the flow of additional amounts of fuel to the carburetor according to a predetermined schedule.

A still further object of the invention is to provide a variable area venturi type carburetor with a vacuum level control valve operable during cold engine operation to modify the normal level of an engine vacuum source used to control the fuel metering signal so that for the same airflow setting of the throttle plate, a change quantity of extra fuel is mixed with the air as compared to the quantity normally provided during cold engine temperature operations.

Other objects, features and advantages of the invention will become more apparent upon reference to the succeeding detailed description thereof, and to the drawings illustrating the preferred embodiment thereof; wherein, FIG. 1 is a plan view of a variable area venturi type carburetor embodying the invention;

Figure 1:
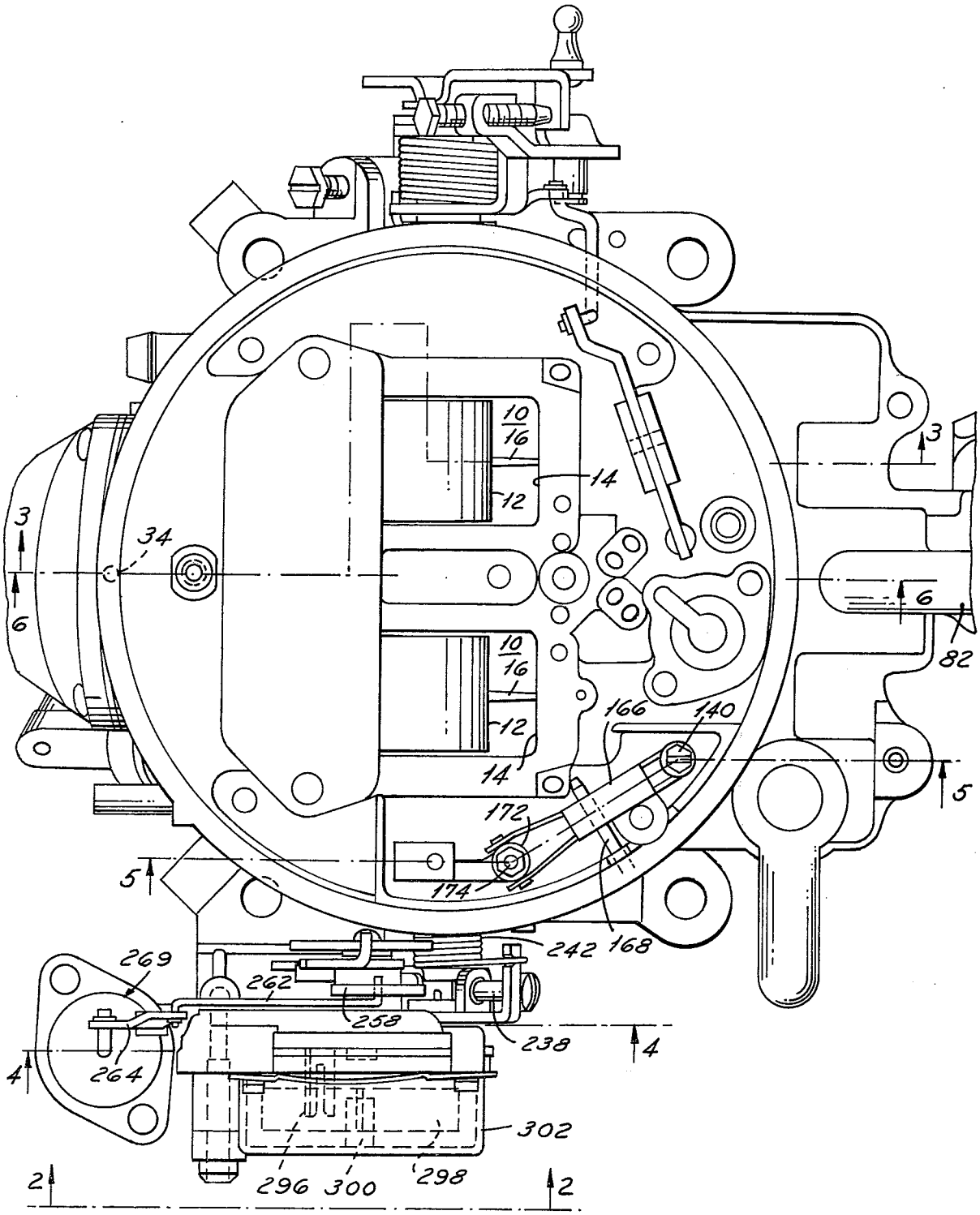
Figure 4:
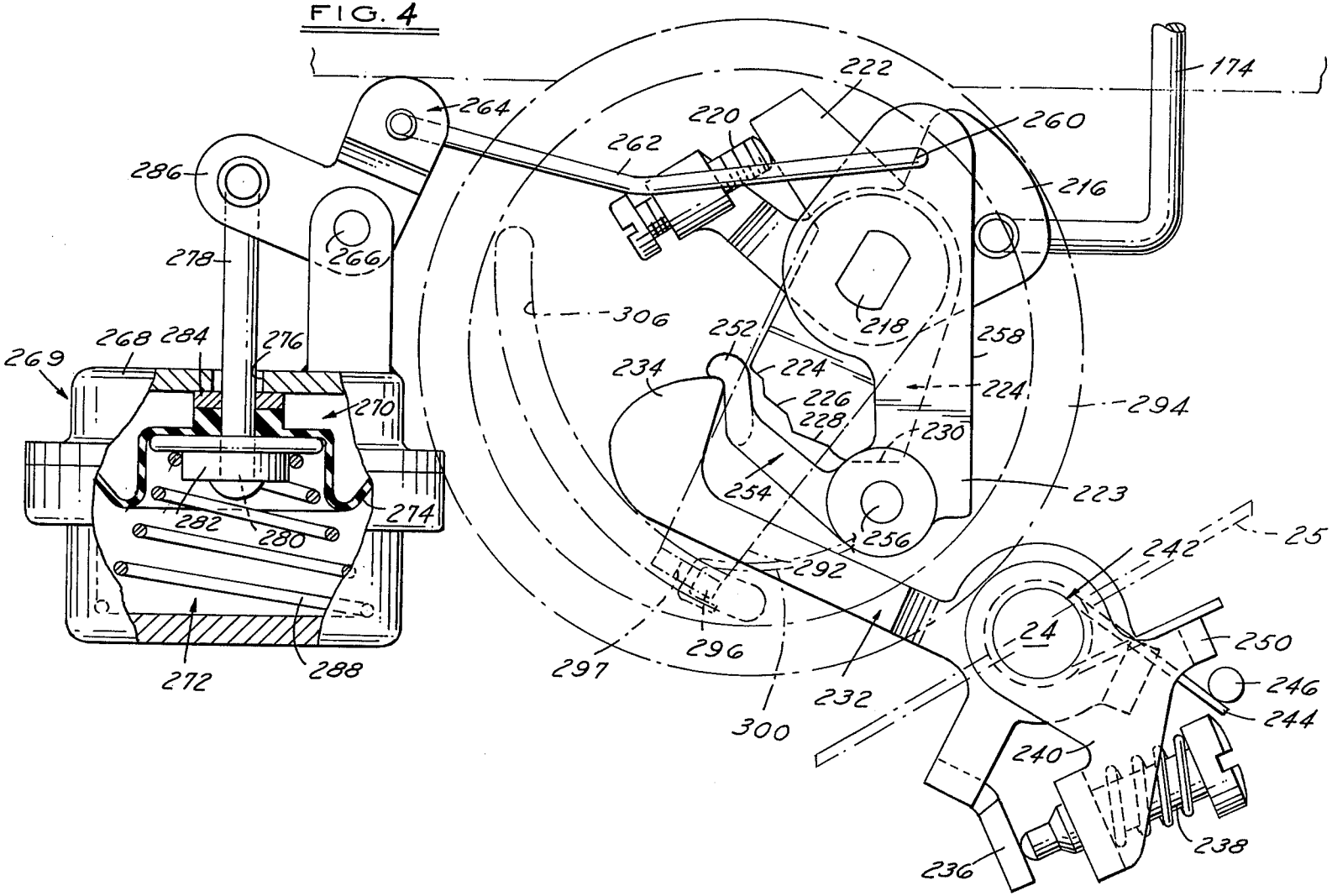
Figure 5:
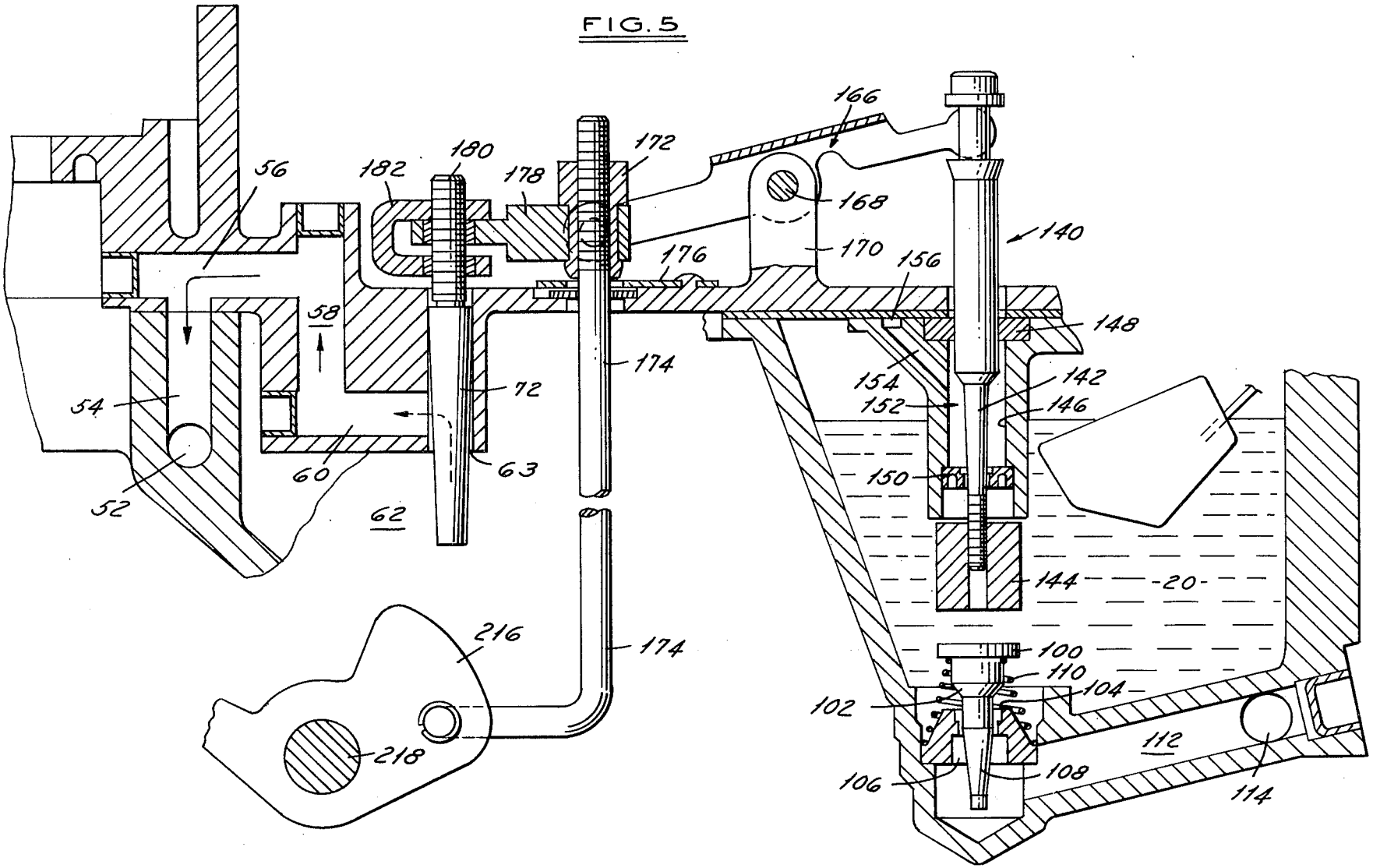
Figure 6:
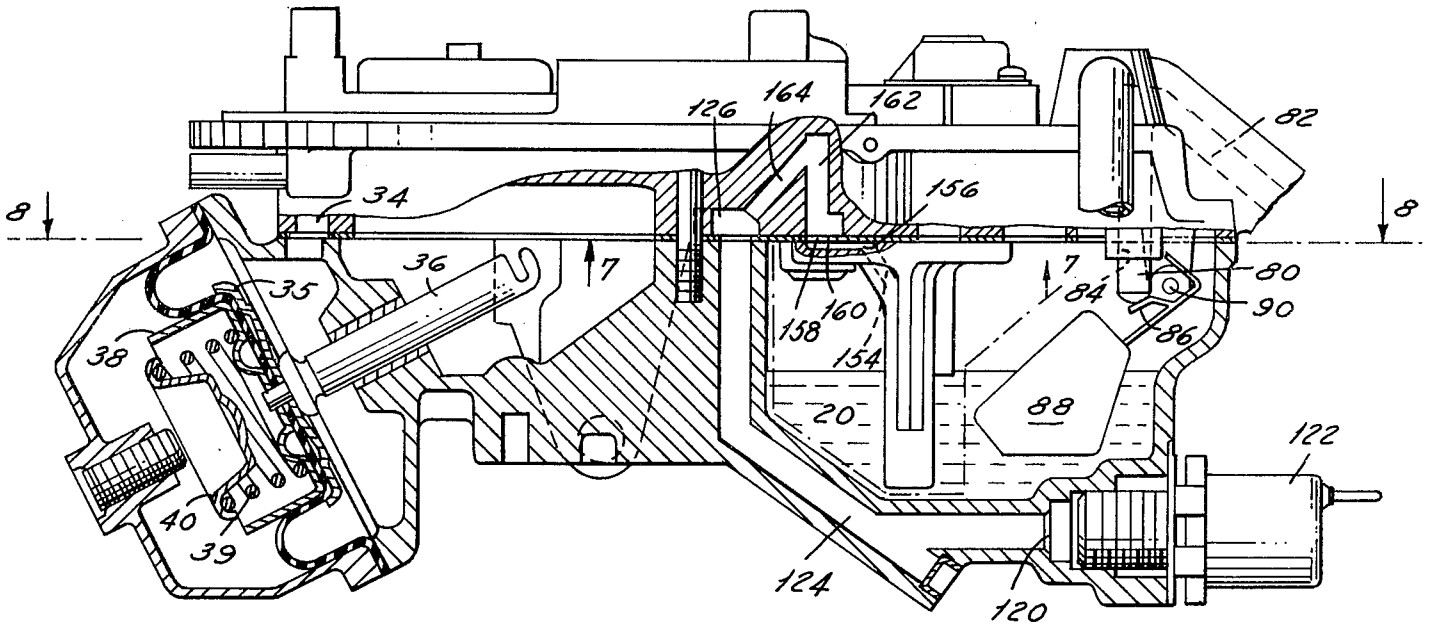
Figure 10:
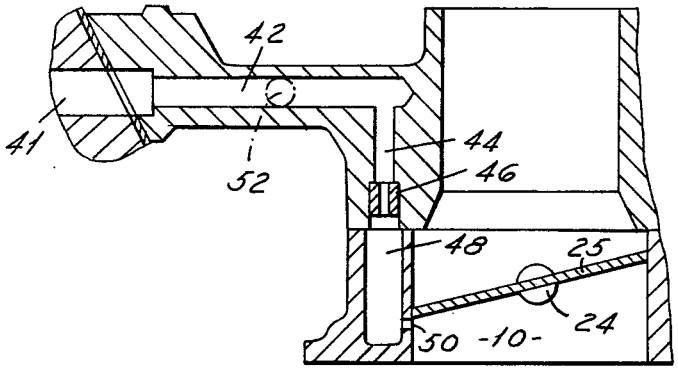
Figure 9:
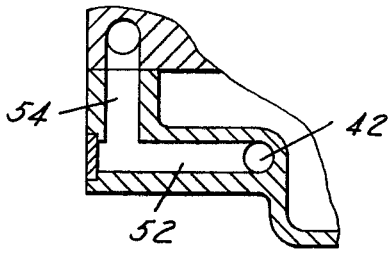
Figure 7:
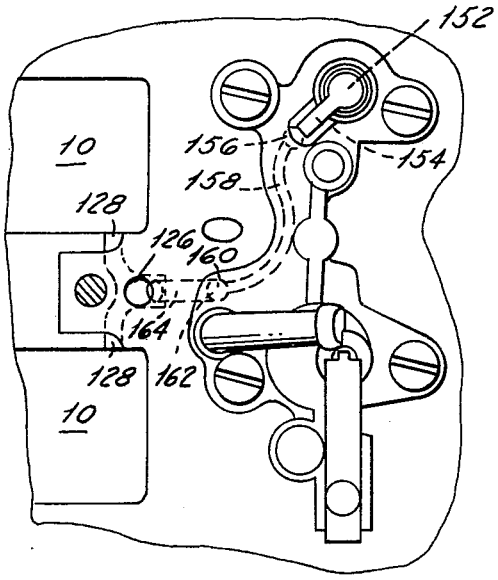
Figure 8:
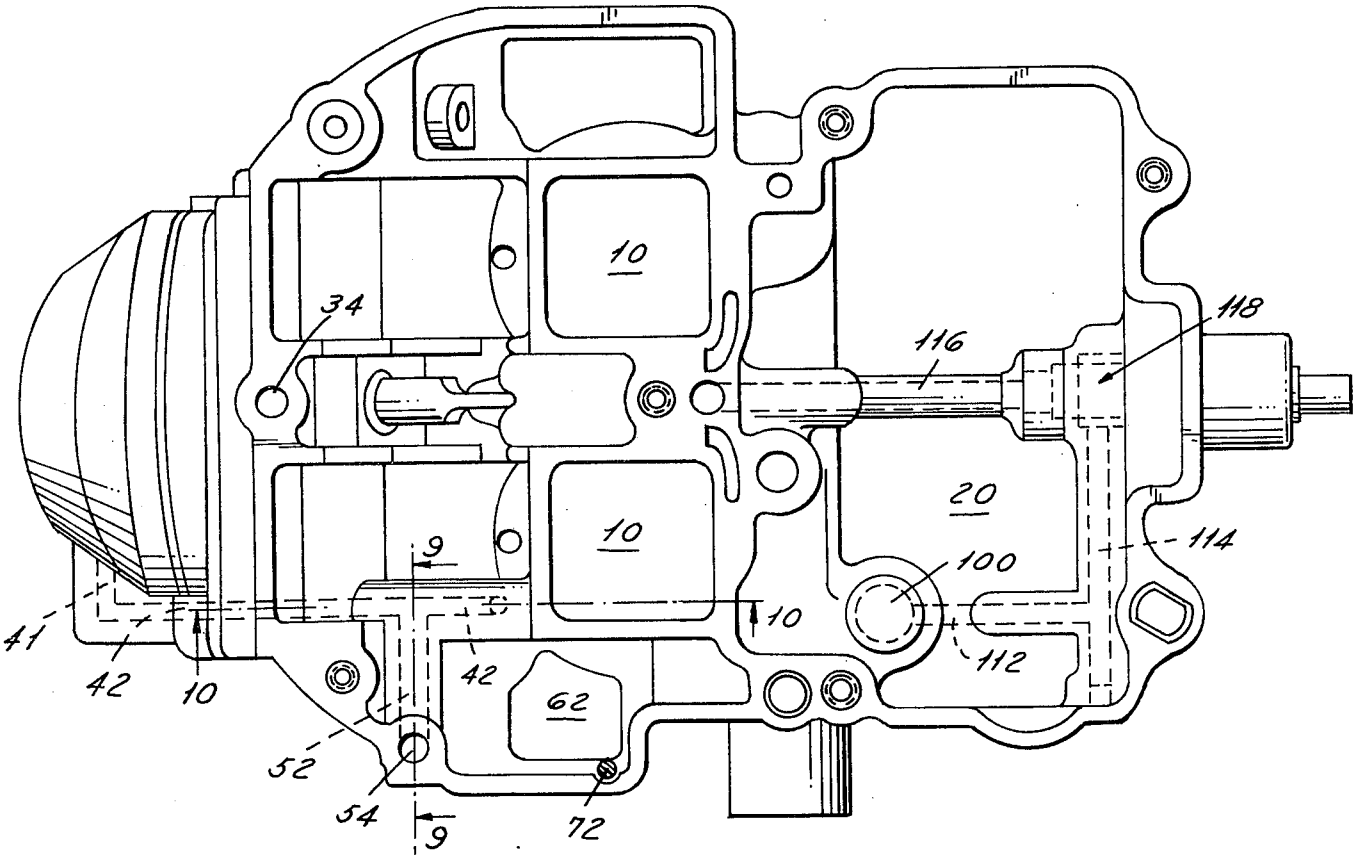

FIGS. 4 and 5 are enlarged cross sectional views taken on planes indicated by and viewed in the direction of the arrows 4—4 and 5—5 of FIG. 1;

FIG. 6 is a cross sectional view taken on a plane indicated by and viewed in the direction of the arrows 6—6 of FIG. 1;

FIG. 7 is a bottom view taken on a plane indicated by and viewed in the direction of the arrows 7—7 of FIG. 6, and looking up at the underside portion of the air horn portion of the carburetor;

FIG. 8 is a cross sectional view taken on a plane indicated by and viewed in the direction of the arrows 8—8 of FIG. 6 and looking down on the main or central body portion of the carburetor; and, FIGS. 9 and 10 are cross sectional views taken on planes indicated and viewed in the direction of the arrows 9—9 and 10—10 of FIG. 8.

FIG. 1, which is essentially to scale, is a plan view of a variable area venturi carburetor of the downdraft type. It has a pair of rectangularly shaped induction passages 10, each having one end wall 12 which is pivotally movable and has the profile (FIG. 3) of one-half of a venturi 13. Each opposite fixed cooperating wall 14 is formed with the mating profile of a portion of a venturi. The airflow capacity, therefore, varies in proportion to the opening movements of walls 12 of the induction passages.

Figure 3:
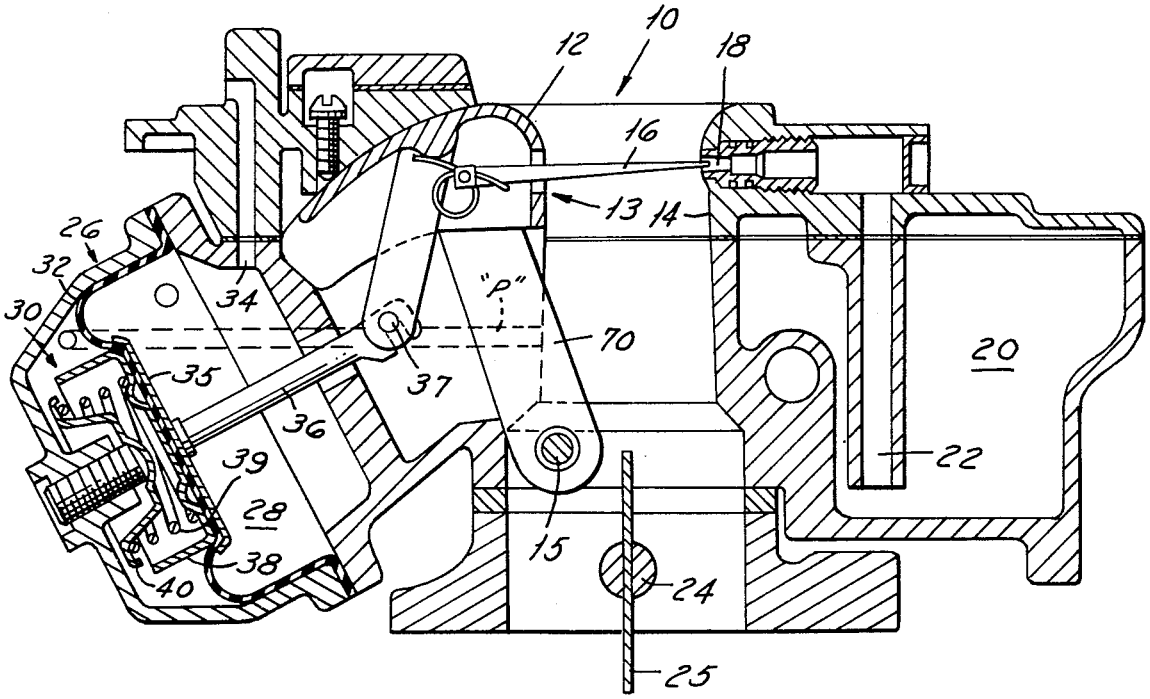
FIG. 3 is a cross sectional view taken on a plane indicated by and viewed in the direction of the arrows 3—3 of FIG. 1.

As seen more clearly in FIG. 3, movable walls 12 are pivotally mounted at 15 on a stationary pin. The pin actually is fixed to a strut, not shown, that depends from a section of the upper body of the carburetor. Pivotally attached to each of the wall bodies is a fuel metering rod 16 that cooperates with a main fuel metering jet 18. The needles have a controlled taper to provide a richer air/fuel mixture at the lower and higher ends of the venturi opening range. Each jet is located in an aperture inside wall 14 at approximately the throat or most constricted section of venturi 13. A fuel float bowl or reservoir 20 has a pair of identical passages 22 conducting fuel to the main metering jets 18. Downstream of the venturis, the carburetor throttle body portion 23 rotatably mounts a shaft 24 on which are fixed a pair (only one shown) of conventional throttle plates 25 that control the flow of air and fuel through induction passages 10.

The size of venturis 13 and the movement of walls 12 is controlled in this case by a spring returned, control vacuum actuated, diaphragm type servo 26. The servo consists of a hollow two-piece casting divided into two chambers 28 and 30 by an annular flexible diaphragm 32. The diaphragm is sealingly mounted along its edge in the casting. Chamber 28 is an air chamber, connected to ambient or atmospheric pressure through a passage 34 (indicated also in FIGS. 1, 6 and 8). Chamber 30 is a vacuum chamber connected to induction passages 10 at a point below the throat but still in the venturi 13. This subjects chamber 30 to changes in a control vacuum that varies with airflow but at a rate that is slightly different than true venturi vacuum. The exact location of the tap of course is a matter of choice. Chamber 30 also is connected to be actuated by ported intake manifold vacuum, for cold weather operation, as will be described in more detail later.

Completing the construction, servo 26 has fixed to one side of diaphragm 32, by a retainer 35, a plunger or actuator 36. The plunger is pivotally connected to a shaft 37 interconnecting cast portions of the movable walls 12. Fixed to the other side of diaphragm 32 is a retainer 38 against which is seated a spring 39. The other end of the spring bears against a seat 40 axially adjustable to vary the spring preload.

FIG. 3 indicates schematically in dotted lines a passage "*p*" between chamber 30 and induction passages 10. In actuality, as best seen in FIGS. 5, 8, 9 and 10, servo chamber 30 is connected by a restricted line 41 (FIG. 8) to an intersecting passage 42 (FIGS. 8-10). Passage 42 intersects with a vertically downwardly extending passage 44 (FIG. 10) containing a flow restrictor or orifice 46 and terminating in a chamber 48. Chamber 48 is connected by a port 50 to induction passage 10 at a point below the edge of throttle valve 25 when it is in its closed position shown. In the position shown, therefore, as the throttle valve is rotated to an open position, port 50 is progressively subjected to the increased pressure above the throttle valve to bleed the vacuum in passage 42.

Passage 42 also intersects with a right angled passage 52 (FIGS. 8, 9 and 5) that connects to a passage 54 (FIG. 5). The latter passes vertically through the main body portion of the carburetor into a horizontal passage 56 located in the carburetor air horn section. Passage 56 in turn is connected by a pair of passages 58 and 60 to the well 62 (FIG. 8) in which is arcuately movable one of the mounting members 70 (FIG. 3) for movable wall 12. While not shown, the well 62 in FIG. 8 and the adjacent induction passage 10 are interconnected by a depressed portion of the main body between the two so that the opening 63 shown in FIG. 5 senses the control or venturi-like vacuum connected by the passages named to servo chamber 30.

Looking now at FIG. 5, the opening 63 to the control vacuum in this case is adapted to be alternately restricted or progressively opened by a needle type valve 72. The valve is movable into and out of the seat 63 in response to a temperature sensitive element, in a manner that will be described more clearly later. Suffice it to say at this point, that during normal engine operating temperatures, the needle valve 72 is completely withdrawn from opening 63 thereby permitting venturi-like vacuum to be sensed through passages 60, 58, 56, 54, 52, 42 and 40 to chamber 30 of the servo, the ported manifold vacuum simultaneously being sensed through port 50, chamber 48, line 42 to line 41 and servo chamber 30.

It should be noted that the size of the venturi-like vacuum passages 60, 58, 56, 54 and 52 are considerably larger than that of the ported manifold vacuum passage 44, coupled with the orifice 46, so that when the needle valve 72 is in the up position, the manifold vacuum is bled to the level of the venturi-like or control vacuum and, therefore, has essentially no effect on the movement of servo 26. The manifold vacuum is used during cold weather operations to modulate the venturi-like or control vacuum to schedule the opening of the venturi 13 to regulate the richness of the fuel/air mixture. When the needle valve 72 is in the closed or nearly closed position, the venturi vacuum flow will be essentially blocked and manifold vacuum will be the prime force acting on servo chamber 30. This will cause the movable venturi walls 12 to be moved to a larger area venturi pulling the fuel metering rods 16 out further.

As thus far described, during normal engine operating temperatures, the operation is as follows. The rotative movement of throttle valves 25 controls total airflow through both passages 10 to increase as the throttle valves are moved from their closed position. An increase in airflow provides essentially a proportional increase in the control vacuum in chamber 30 from port 63 until the diaphragm 32 is moved towards the cup 40. This moves both walls 12 to open induction passages 10 and increase the area of venturis 13 while simultaneously retracting the fuel metering rods 16 to increase fuel flow. Thus, the total airflow and fuel flow vary with changes in throttle valve setting up to a maximum.

Returning now to the general construction shown in FIG. 1, during cold engine operation, as stated previously, it is desirable to provide an additional supply of fuel to the induction passages to assure sufficient fuel vapor both for starting the engine as well as a different schedule of additional fuel for running the cold engine prior to its reaching normal operating temperature level. The present invention satisfies these requirements by providing a combination fuel enrichment system, a cranking fuel enrichment system, as well as a throttle plate positioner device to crack open the throttle plates an additional amount during cold starting operations.

More specifically, FIGS. 5, 6 and 8 show portions of both the cold running enrichment system as well as the cold start cranking fuel system. The body portion of the carburetor is cast with a fuel bowl 20 containing fuel delivered thereto past a conventional inlet needle valve 80 from a supply line 82. The needle valve 80 is moved vertically in a bore 84 by the tap 86 secured to a float member 88 pivotally mounted at 90 on a depending portion of the air horn section of the carburetor.

The inlet valve 80 operates in a known manner. Movement of float 88 downwardly as a result of lowering of the liquid fuel level causes the needle 80 to drop. This permits fuel under pressure to enter the reservoir from line 82 to fill it again to the desired level. Raising of the float raises the inlet valve against the conical seat shown to shut off the supply when the desired level has been reached.

The lower portion of fuel bowl 20 contains a spring opened cranking fuel supply valve 100 (FIG. 5). The latter has a conical valve portion 102 that cooperates with an annular knife edge seat 104 located in the end of a fuel passage 106. Valve 100 has a tapered stem portion 108 and is biased upwardly by a spring 110 to open passage 106 to the flow of fuel from bowl 20. An intersecting passage 112 (FIG. 8) connects with a cross passage 114 to flow fuel into another passage 116 past a solenoid controlled valve unit 118.

As best seen in FIG. 6, unit 118 consists essentially of a valve 120 formed on the end of the armature of a solenoid 122. A spring not shown normally biases valve 120 to close communication between passages 114 and 116. The solenoid normally would be powered from the starter relay of the motor vehicle ignition system so that the solenoid is rendered operative only during engine starting conditions. That is, when the ignition key is turned to the start position, the solenoid 118 would be energized and cause valve 120 to be retracted rightwardly to open communication between passages 114 and 116. A flow of starting fuel would then be permitted from fuel bowl 20 to passage 116.

As soon as the engine attained running condition, return of the ignition switch to the on position would deenergize solenoid 122 and again block passage 114 from communicating with passage 116. The solenoid unit could include a manifold vacuum switch so the solenoid is not energized above a vacuum level of say 2 inches Hg., for example. It also could contain a thermal switch to prevent operation above 80°F., for example, when extra cranking fuel usually is not needed.

From passage 114 the fuel passes upwardly through the carburetor main body passage 124 (FIG. 6) where it flows into a plenum 126, as shown also in FIG. 7. From the plenum, the fuel is divided equally to be inducted out through passages 128 into each of the induction passages 10 at a location adjacent the venturi but spaced from the fuel jets 18. Thus, it will be seen that for starting operations, energization of the solenoid by turning of the vehicle ignition switch causes additional fuel to be added at times to the induction passages, for starting purposes.

The quantity of cranking fuel to be added to the induction passages, or, on the other hand, the position of cranking valve 100, is controlled by the lower end of a needle valve 140 (FIG. 5) that forms a portion of the engine running fuel enrichment system. More specifically, needle valve 140 is tapered at its lower end as shown at 142 and has threaded to it an abutment portion 144. The latter is adapted to engage the cranking valve 100 when the needle valve is moved downwardly during warmer than the coldest weather operations. The screw connection of member 144 to the needle valve provides axial adjustment for varying the characteristics of the fuel flow.

The needle valve 140, in this case, is vertically movable in a well 146 in the upper body portion. It is axially aligned by a seal 148 and a valve seat 150 with which it cooperates to meter fuel. The seal and seat define a chamber 152 which is connected by an angled passage 154 to the end 156 of a worm-like passage 158 best seen in FIG. 7. The opposite end 160 of passage 158 connects with a vertical passage 162 (FIG. 6) that intersects an angled passage 164 leading to the plenum 126. As stated previously, plenum 126 also receives fuel from the cranking fuel passage 124. Together then, the fuel passes into each induction passage 10 through the side passages 128. It will be seen then that, depending upon the vertical position of needle valve 140, a quantity of fuel will flow past the tapered portion 142 of the needle valve into the various passages into induction passages 10 to supply additional fuel during cold running operation of the engine.

The vertical movement of needle valve 140 is controlled by a temperature sensitive element that moves the needle valve 140 upwardly to increase fuel flow as the temperature decreases below the normal operating level, and moves the needle valve 140 to a downward position to shut off the fuel enrichment when the temperature reaches the normal operating level. Concurrently, the downward movement of needle valve 140 as the temperature increases will move the cranking fuel valve 100 downwardly against the force of spring 110 in proportion to the temperature increase. Therefore, when the normal operating level is reached, cranking valve 100 will be completely closed against seat 102 and no additional fuel will then be added during starting of the engine.

The upper end of needle valve 140 is pivotally connected to the end of a lever 166. The lever is pivotally mounted on a pin 168 projecting through an aperture in a boss 170 projecting from the carburetor upper body. The opposite end of lever 166 is pivotally connected to an adjustable nut 172 on the upper end of a depending link 174. The link 174 is adapted to be connected to a thermostatically responsive movable element to be described. Adjusting the upper end 172 of course will vary the operating characteristics of the system. Downward movement of link 174 is limited by abutment of the nut 172 against a stop washer 176. Projecting horizontally or laterally from link 174 is a connector 178 pivotally engaging the threaded upper end 180 of needle valve 72. The upper end 180 contains a yoke member 182 adjustably threaded to the end of needle valve 72 as shown to determine the upward and downward limits of movement of the needle valve.

As thus far described, therefore, with respect to the running fuel enrichment system, with the throttle plates in the idle speed positions, when link 174 is in the position shown indicating that the temperature is at the lowest below normal engine operating level, the needle valve 140 will have been moved to its upwardmost position to provide maximum rate of fuel flow. Needle valve 72 also will have moved to its downwardmost position restricting the port or outlet 63 to the induction passage shown in FIG. 8. Thus, ported manifold vacuum in port 50 (FIG. 10) will act in servo chamber 30 to move walls 12 to enlarge the venturi areas, which decreases the fuel metering signal acting on both outlet passages 128 and jet 18. This leans the mixture as compared to the cranking mixture and what it would be under accelerative conditions.

Simultaneously, maximum additional fuel quantity will flow from the fuel enrichment well 152 into the induction passages 10 through the interconnecting outlet passages 128. As soon as the temperature increases from its lowest setting, the link 174 will move vertically upwardly from the position shown. This will gradually and progressively raise the venturi-like vacuum control needle valve 72 and lower progressively the needle valve 140. Thus, the venturi-like control vacuum begins to bleed into passage 60. The vacuum force acting on servo chamber 30 will progressively decrease to permit servo spring 39 to slowly close the venturi towards the normal engine idle speed position. The additional fuel enrichment will decrease as the tapered portion 142 of needle valve 140 closes the opening to the fuel bowl.

Figure 2:
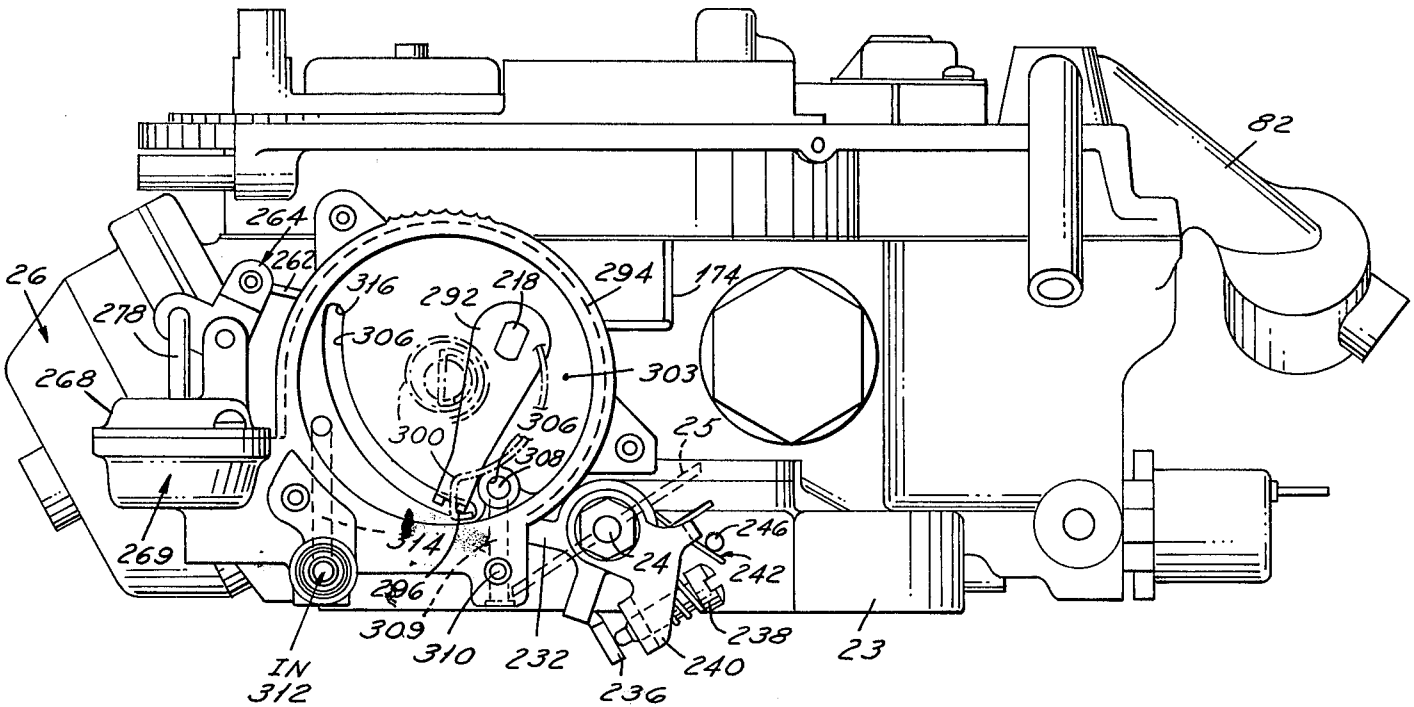
FIG. 2 is a side elevational view taken on a plane indicated by and viewed in the direction of the arrows 2—2 of FIG. 1.

Turning now to the temperature responsive control of the movement of link 174 and the throttle valve positioner, FIGS. 1, 2 and 4 show the same more clearly. As best seen in FIG. 4, the lower end of link 174 is pivotally connected to one end of a lever 216 that is fixed on a shaft 218. The other end of lever 216 adjustably supports a screw 220 that bears against the end 222 of an essentially conventional fast idle cam 224. The cam is rotatably mounted on shaft 218 and has a weighted lower end 223. The end has a peripheral edge portion formed with a series of circumferentially contiguous steps 224, 226 and 228 and a high cam step 230. Each step progressively in the order named is of greater radial extent than the previous.

Cooperating with fast idle cam 224 to locate or position the throttle plates 25 is a lever or throttle stop 232 formed at its outer end with a curved engaging portion 234. Lever 232 is rotatably mounted on throttle shaft 24. It has a depending tang portion 236 engaged by the end of an adjustably mounted screw 238 carried by a linkage 240 fixed to the throttle shaft 24. A throttle return coil spring 242 has one end 244 anchored under a pin 246 extending from a fixed portion of the carburetor throttle flange. The opposite end of the spring bears against an angled tang 250 of linkage 240 thereby biasing the linkage and screw 238 in a clockwise direction against the tab end 236 of lever 232. The lever 232 thus is constantly biased in a clockwise direction towards the edge surface of fast idle cam 224. The cam steps therefore constitute abutment means or stops in the path of movement of lever 232 to determine the idle speed position of throttle plates 25.

Insertable at times between the end 234 of lever 232 and the edge of fast idle cam 224 is the finger portion 252 of an arcuately movable link 254. The latter is pivotally connected at 256 to the end of a lever 258 rotatably mounted on shaft 218. Lever 258 is connected at its upper end at 260 to an actuating link 262. The opposite end of link 262 is connected to one end of a bell crank lever 264 pivotally mounted at 266 on the ears of an extension of a servo housing 268.

The servo housing is hollow and divided into two chambers 270 and 272 by an edge mounted annular flexible diaphragm 274. Chamber 270 is an air chamber communicating to the atmosphere through an opening 276. Chamber 272 is a vacuum chamber communicating by a passage not shown with the induction passages at a location below the throttle valves 25. A plunger 278 is riveted at one end 280 to a hat shaped spring retainer 282, and projects through a stop 284 for connection to the opposite end 286 of bell crank lever 264. A compression spring 288 normally biases the plunger 278 upwardly to move bell crank 264, link 262, level 258 and finger portion 254 in a clockwise direction.

Application of engine vacuum to the servo chamber 272 when the engine is running is sufficient to counteract the force of spring 288 and cause the plunger 278 to move vertically downwardly. This moves lever 258 and finger portion 254 in a counterclockwise direction to withdraw or retract the finger portion from between the lever end 234 and the fast idle cam steps.

Thus, it will be seen that when the engine is off preparatory to starting operation, depression of the vehicle accelerator pedal will rotate throttle shaft 24 and lever 232 in a counterclockwise direction away from the end 252 of finger portion 254. Since there is no manifold vacuum in chamber 272 of servo 269, spring 288 will position the finger portion 254 to the position shown so that upon release of the accelerator pedal, coil spring 242 will cause a clockwise return movement of the throttle valve lever 232 until it engages the arcuate portion 290 of the end 252 of the finger portion 254, which in turn abuts the edge of the fast idle cam 224.

Once the engine has attained running operation beyond cranking vacuum level, then opening of the throttle valves 25 by depression of the accelerator pedal, pivots lever 232 downwardly and permits retraction or movement of finger portion 254 to an inoperative position to the right by the vacuum in servo 268. Lever 232 then is permitted to engage the edge of the fast idle cam directly and the position of the throttle plates will be determined strictly by the rotative position of the fast idle cam 224.

The fast idle cam is controlled in its rotation by a lever 292 fixed on shaft 218. The lever is located within a hollow cup-shaped housing 294 that is cast integrally with the throttle body portion 23. Lever 292 has an upturned slotted end 296 in which is located the outer end 297 of a thermostatically responsive bimetallic spring coil 298. The inner end of the spring is fixed on a stub shaft 300 projecting from an insulated cover 302. The cover is fastened by screws to the housing 294 with an insulating gasket 302 between. The gasket has an arcuate slot 304 along which the end 296 moves with temperature changes. The gasket also has a hole 306 through which projects the end 308 of a tube connected by a pair of passages 309 and 310 to the induction passages 10 at a location (not shown) below the throttle valves. For clarity, the cover 302 has been removed in FIG. 2, and FIG. 4 shows the outline of the housing in phantom, for orientation purposes. Completing the construction, the housing has a hot air inlet tube 312 connected by a passage 314 to the interior of housing 294 on the far side of gasket 302. The tube would emanate from a known type of exhaust manifold heated stove in which air flowing past the manifold is warmed.

In operation, once the engine is operating, with gasket 302 in place and cover 304 applied, manifold vacuum acting in passages 309 and 310 causes hot air to flow into tube 312 to the far side of gasket 302. The air is then drawn through the slot 306 and out through passages 309 and 310, warming the coil 298 as it passes it. Thus, the coil will be progressively warmed as the engine temperature rises, resulting in a circumferential movement of the end 297 of the coil to rotate lever 292 in the same direction. This rotates lever 216 away from the fast idle cam and permits the fast idle cam to rotate counterclockwise by gravity. Similarly, upon engine shutdown, cooling of the coil will cause it to rotate levers 292 and 216 in the opposite direction. This of course simultaneously rotates the fast idle cam 224 by the screw 220, so that, depending upon the temperature level, one of the steps 225, 226, 228 or the high cam step 230 will be presented opposite the end 234 of throttle lever 232. Thus, the throttle plate idle speed setting will be determined by which step is engaged by lever 232, during running operations of the engine. During cold start operations, as described previously, the finger portion 254 will be inserted between the end 234 of lever 232 and whatever step or rotative cam position the fast idle cam 224 has attained so that the throttle plates are opened more for starting purposes than during normal cold running conditions.

It will be seen, therefore, that regardless of what position the fast idle cam 224 assumes because of the prevailing ambient temperature, the throttle plates will be opened an additional amount for starting purposes. The additional amount will vary to agree with the ambient temperature level so that a correct starting air/fuel mixture is obtained. This is in contrast to the conventional constructions in which there is only one fast idle start position, accomplished only by positioning the single high step 230 against the throttle lever end 234. At the inbetween temperature levels, this is too high and results in too fast an idle speed, and one that may provide undesirable emissions.

The overall operation of the carburetor is believed to be clear from the above description and by reference to the drawings. Therefore, it will be repeated now only briefly. Assume that the engine is off and the ambient temperature is essentially 0°F. The coiled bimetallic spring 298 will have contracted a maximum amount rotating lever 292 clockwise from the position shown in FIG. 2 to position the end 297 of the lever at the left end 316 of the slot 306. This will rotate lever 216 to move the fast idle cam 224 clockwise to locate the high cam step 230 opposite the end 234 of throttle lever 232. Simultaneously, by opening the throttle plates, lever 232 will move away from the fast idle cam and permit the servo spring 288 to move the finger portion 254 between the fast idle cam step 230 and lever 232. The throttle plates now will be opened a maximum amount for the coldest start positions. The induction passages 10 at this time are at their smallest cross section because the servo spring 39 has moved walls 12 to this position. This, therefore, exposes the passages to a larger cranking vacuum signal so that the airflow across the fuel metering jets 18 is increased.

Simultaneously, the rotation of lever 216 moves link 174 downwardly to its extreme position until the stop 172 shown in FIG. 5 abuts the washer 176. This pivots needle valve 140 to its uppermost position allowing a maximum amount of fuel past the tapered lower portion from fuel bowl 20. This upward position also permits the upward movement of the cranking valve 100 by the spring 110 to open wide the passage 106 to flow fuel to passage 112. Therefore, when the ignition switch is turned to an on or start position, the solenoid 118 will withdraw the valve 120 to permit fuel to flow from passage 114 to 116.

When the engine is cranked for starting purposes, the cranking vacuum signal is sufficient acting across the induction passage outlets 128 (FIG. 7) to draw fuel up cranking fuel circuit passage 124 into plenum 126. Simultaneously, fuel is drawn past the engine running fuel circuit needle valve 140 into the worm passage 158 (FIG. 7) to plenum chamber 126, where both circuits combine and the fuel inducted to provide the necessary starting richness. Once the engine has been started, release of the ignition switch to the engine running position de-energizes solenoid 118 to then again block the connection between the cranking supply line 114 and the line 116. However, with the link 174 in its downwardmost coldest position, the valve 72 will also be down essentially blocking off port 63. Accordingly, the higher ported engine running manifold vacuum will act in servo chamber 30 and draw the walls 12 of the venturis to open or enlarge the venturi area.

With the throttle plates unmoved from the fast idle speed position, the opening of the venturis will decrease the air velocity across the fuel jet 18 to decrease the fuel metering signal while at the same time enlarging the fuel jet orifices. Simultaneously, the area of discharges 128 being constant, lowering the air velocity decreases the fuel metering signal to decrease fuel output through these passages. This leans the overall mixture for the closed throttle position attained at that temperature level. At closed throttle, the manifold vacuum is considerably higher than the cranking vacuum. This causes excess vaporization and would normally lead to a richer than desired mixture. However, the ported manifold vacuum control in this case compensates for this by leaning the overall mixture to the desired level by opening the venturis.

Similarly, once the throttle plates are moved to an off-idle accelerative position, the manifold vacuum level is reduced so that there now is less vaporization. A slightly richer mixture, therefore, is desired to provide acceptable engine operation. This is accomplished by the throttle plates traversing the port 50 as they move off-idle, which progressively subjects the chamber 48 to more and more control vacuum existing above the throttle plates. The manifold vacuum signal acting on servo 30 therefore decays, and the venturi moves towards a more closed position to provide the richer setting desired. It is only a very short time, therefore, before the throttle plates have completely traversed the port 50, leaving control of movement of the venturi then strictly to the changes in venturi-like control vacuum. Thus, a richer than normal idle but less than cranking mixture is provided at this time by the main fuel metering system as well as the needle valve supplemental feed system.

Concurrent with the engine attaining a running condition, the manifold vacuum established in servo chamber 272 will be sufficient, once throttle lever 232 is pivoted counterclockwise to release finger portion 254, to pivot the finger portion out from between the end 234 of lever 232 and the fast idle cam step it abuts. Now the portion 234 will move to directly abut the step of the idle cam 224 and thereby close down the throttle plates to less open fast idle speed positions. This reduces both the fuel flow and airflow for cold running operations, which as stated above is desired because a less rich air/fuel mixture is required once the engine has attained its idle speed horsepower.

As the temperature increases, the bimetallic coiled spring 298 will rotate the lever 216 in a counterclockwise direction away from the fast idle cam. The cam then can move in the same direction by gravity when the throttle plates are opened beyond the fast idle position so that the end of lever 234 gradually moves progressively clockwise to permit the progressive closure time, the throttle plates to less open idle speed positions. Simultaneously, the counterclockwise rotation of lever 216 effects an upward movement of link 174 to progressively move the needle valve 140 downwardly and thereby progressively close off the additional fuel flow past the valve. This movement also causes an upward movement of needle valve 72 so that the venturi-like vacuum decays whatever ported manifold vacuum signal is acting in servo chamber 30.

Thus, for closed throttle plate positions, the lowering vacuum signal in pressure chamber 30 will permit the venturi walls 12 to move to contract the venturi area and move the metering rods 16 into the jets 18. Eventually, therefore, the throttle plates will be returned to a normal closed idle speed position, the needle valve 72 will be drawn essentially completely out of port 63 so that movement of the venturi walls will be controlled solely by control or venturi-like vacuum changes, and the supplemental fuel needle valve 140 will be moved downwardly to shut off or essentially close off the supply of additional fuel to the system. At this tiem, the cranking valve 100 will be shut so that even if solenoid 122 opens during engine start condition, no additional cranking fuel will be added to the engine when the engine is started at a normal operating temperature level. The closing venturi increases the air velocity past the fuel jet 18. The fuel jet, therefore, will have a smaller flow area. The total fuel flow will be less because the throttle plates are now closed more completely and because no fuel is now being inducted from passages 128, but only that through the main jets 18.

From the foregoing, therefore, it will be seen that the invention provides a modulated vacuum control signal that modifies the normal cold engine fuel circuit supplies to provide a tailored schedule of fuel flow for better cold engine operation.

While the invention has been shown and described in its preferred embodiment, it will be clear to those skilled in the arts to which it pertains that many changes and modifications may be made thereto without departing from the scope of the invention.

We claim:

1. A variable area venturi carburetor having an air and fuel induction passage connected to air at one end and to an engine intake manifold at the opposite end to subject the passage to the changing engine manifold depression for the induction of air and fuel into the engine, a throttle plate rotatably mounted across the passage for controlling flow through the passage, the induction passage containing a venturi providing a change in velocity and pressure level to fluid flow therethrough, a control pressure sensing port opening into the venturi to subject the port at all times to the pressure depression in the venturi, the venturi including a movable wall movable to vary the venturi flow area, vacuum responsive servo means connected to the movable wall for variably moving the wall to vary the venturi area between a minimum area engine idle speed position and a maximum area engine wide open throttle position, first conduit connecting the pressure port to the servo means for communicating the control pressure level in the venturi to the servo means to move the same and thereby move the movable wall to vary the venturi area in response to opening movement of the throttle plate, second conduit means connected at one end to manifold vacuum in the induction passage below the throttle valve at a location to be traversed by the edge of the throttle valve during opening movement of the throttle valve to subject the second conduit means to progressively lower manifold vacuum force levels, means connecting the opposite end of the second conduit means to the first conduit means between the port and servo means, the first conduit means having a larger flow area than the second conduit means to thereby effect the decay of the level of manifold vacuum force in the second conduit means to the level of the control pressure in the first conduit means whereby the control pressure in the control port alone controls the movement of the servo means during normal operation of the engine at normal temperature levels and thereby alone controls variance of the venturi area during this time, and means to progressively change control of the servo means from the control pressure to the manifold vacuum as the temperature level changes from the normal level to the coldest extreme below the normal level, the latter means comprising temperature responsive valve means movable variably into the first conduit means in response to the attainment of below normal engine operating temperature levels to progressively restrict the communication of control pressure from the port to the servo means as a function of decreasing temperature and thereby progressively switch control of the movement of the servo means and venturi wall from the control pressure in the venturi to the manifold vacuum in the second conduit means, and means movable in response to temperature changes below the normal engine operating temperature level connected to and moving the temperature responsive valve means.

2. An enrichment device as in claim 1, the temperature responsive means including a needle valve, movable into and out of the conduit means to block and unblock bleed of manifold vacuum by the venturi-like vacuum.

3. An enrichment device as in claim 2, the temperature responsive means including a temperature sensitive spring movable in response to temperature changes and connected to the needle valve.

4. An enrichment device as in claim 2, including means to adjust the needle valve to vary its characteristics of operation.

* * * * *